US006782902B2

(12) United States Patent
Shover et al.

(10) Patent No.: US 6,782,902 B2
(45) Date of Patent: Aug. 31, 2004

(54) SOOTBLOWER LANCE TUBE FOR DUAL CLEANING MEDIA

(75) Inventors: Stephen L. Shover, Millersport, OH (US); David W. Okel, Pickerington, OH (US)

(73) Assignee: Diamond Power International, Inc., Lancaster, OH (US)

( * ) Notice: Subject to any disclaimer, the term of this patent is extended or adjusted under 35 U.S.C. 154(b) by 116 days.

(21) Appl. No.: 10/049,303

(22) PCT Filed: Jan. 12, 2001

(86) PCT No.: PCT/US01/01130

§ 371 (c)(1),
(2), (4) Date: Feb. 5, 2002

(87) PCT Pub. No.: WO01/51852

PCT Pub. Date: Jul. 19, 2001

(65) Prior Publication Data

US 2003/0205261 A1 Nov. 6, 2003

Related U.S. Application Data

(60) Provisional application No. 60/175,998, filed on Jan. 12, 2000.

(51) Int. Cl.[7] ..... B08B 3/02

(52) U.S. Cl. ..... 134/167 R; 134/169 R; 134/172; 134/181; 134/168 R

(58) Field of Search ..... 134/166 R, 167 R, 134/108 R, 169 R, 172, 180, 181; 122/390, 391, 392

(56) References Cited

U.S. PATENT DOCUMENTS 1,790,403 A * 1/1931 Bowers et al.
1,944,324 A * 1/1934 Howse et al.
3,661,124 A * 5/1972 Winkin
4,209,028 A 6/1980 Shenker
4,248,180 A * 2/1981 Sullivan et al.
4,276,856 A * 7/1981 Dent et al.
4,445,465 A * 5/1984 Byrd et al.
4,526,135 A * 7/1985 Calhoun et al.
5,305,713 A * 4/1994 Vadakin
5,494,004 A * 2/1996 Hunter, Jr.
5,509,607 A 4/1996 Booher et al.
5,560,323 A * 10/1996 Billings
5,619,771 A * 4/1997 Minic
5,667,139 A * 9/1997 Dickie
5,836,268 A * 11/1998 Wall
6,065,528 A 5/2000 Fierle et al.

* cited by examiner

*Primary Examiner*—Frankie L. Stinson
(74) *Attorney, Agent, or Firm*—Brinks Hofer Gilson & Lione

(57) ABSTRACT

A long retracting sootblower device for conducting different cleaning media types to the interior of a heat exchanger having a lance tube assembly (12), a feed tube, a carriage assembly (1), a first cleaning media supply, and a second cleaning media supply. The lance tube assembly includes a manifold (25), a hub (21) mounted to the manifold (25), a tube section (13) extending outward from the hub (21), and a nozzle assembly (18). The nozzle assembly includes nozzles (50, 52) adapted for directing a stream of cleaning media. The manifold (25) includes at least one cylindrical tube (32) with first and second ends, the first end (34) being permanently mounted to the manifold (25), and the second end (35) engaging the nozzle assembly (18). The manifold (25) and cylindrical tube (32) define a first high pressure passage for conducting cleaning media from the first cleaning media supply to the nozzle assembly (18). The manifold (25) also includes a shield assembly (36) for supporting the cylindrical tube (32) within the lance tube assembly (12).

23 Claims, 15 Drawing Sheets

SOOTBLOWER LANCE TUBE FOR DUAL CLEANING MEDIA

CROSS REFERENCE TO RELATED APPLICATIONS

This application claims the benefit of provisional application No. 60/175,998, filed Jan. 12, 2000.

TECHNICAL FIELD OF THE INVENTION

This invention is related to a device for cleaning interior surfaces of a heat exchanger device, and more particularly, to a sootblower for use with combustion air pre-heaters associated with large scale utility or industrial boilers.

BACKGROUND OF THE INVENTION

Sootblowers are used to project a stream of a blowing medium, such as steam, air, or water against heat exchange surfaces of large-scale combustion devices, such as utility boilers. In operation, combustion products cause slag and ash encrustation to build on heat transfer surfaces, degrading thermal performance of the system. Sootblowers are periodically operated to clean the surfaces to restore desired operational characteristics.

Generally, sootblowers include a lance tube that is connected to a pressurized source of blowing medium. The sootblowers also include at least one nozzle from which the blowing medium is discharged in a stream or jet. In a retractable sootblower, the lance tube is periodically advanced into and retracted from the interior of the boiler as the blowing medium is discharged from the nozzles. In a stationary sootblower, the lance tube is fixed in position within the heat exchanger and is periodically rotated while the blowing medium is discharged from the nozzles. In either type, the impact of the discharged blowing medium with the deposits accumulated on the heat exchange surfaces produces both a thermal and mechanical shock that dislodges the deposits. U.S. Pat. Nos. generally disclosing sootblowers include the following, which are hereby incorporated by reference: 3,439,376; 3,585,673; 3,782,336; and 4,422,882.

A typical sootblower lance tube comprises at least two nozzles that are diametrically oriented to discharge streams in directions 180° from one another. Various cleaning mediums are used in sootblowers. Steam and air are used in many applications. Cleaning of slag and ash encrustations within the internal surfaces of a combustion device occurs through a combination of mechanical and thermal shock caused by the impact of the cleaning medium. In order to maximize this effect, lance tubes and nozzles have been designed to produce a coherent stream of cleaning medium having a high peak impact pressure.

In some sootblowing applications, there is a need to periodically change the cleaning media being used in response to changing cleaning requirements within the combustion device or due to the collection of deposits arising from the injection of flue gas treatment chemicals, such as ammonia. Specifically, there is a desire to alternatively use steam or water as a cleaning media. Water and steam have significant operational differences as cleaning media. Steam is the most typical sootblowing media and is used since it is highly effective and can be used over a long-term period without damaging internal surfaces of the heat exchanger elements being cleaned. In some very demanding fouling conditions, steam does not provide the level of cleaning effect necessary. Due to a greater mechanical effect, water is capable of cleaning the most severely fouled surfaces. Water also dissolves salt deposits, such as ammonia bi-sulfate. However, in some applications, continuous use of water is not desired due to a fear of damage to the internal heat transfer components over repeated cycles. Various approaches toward providing dual media sootblowing capabilities have been developed in the past. In one approach, a change of the cleaning media would involve a complete change of the sootblower lance tube, with one having nozzles intended for one type of cleaning media, and another lance tube having nozzles intended for a different type of cleaning media. Specifically, one lance tube would have nozzles adapted for water, and the other lance tube would have nozzles adapted for steam. Due to the different fluid characteristics of water and steam, the water discharge nozzles are considerably smaller in diameter than steam nozzles. Designs of lance tubes having interchangeable nozzles have been considered, but are problematic since the lance tube operates in a hostile environment, and therefore, threads or other precision mating surfaces tend to become degraded in service, making removal and replacement of specialized nozzles difficult.

In the previously described approaches, the task of changing cleaning media is a significant and time-consuming and labor-intensive effort that takes the cleaning equipment out of service for a significant time period. Several other approaches that do not necessitate a complete change In lance tube or nozzles have also been considered. One example is described by U.S. Pat. No. 5,509,607 assigned to the Assignee of this invention and which is hereby incorporated by reference. That patent describes a lance tube having two sets of nozzles with a water discharge nozzle being located upstream along the lance tube, and the steam nozzle at the downstream distal end position on the lance tube. A switch in cleaning media is achieved through the use of a valve positioned between the two sets of nozzles. The patent describes a flow passageway that can either be filled with a plug that substantially blocks the flow of fluid to the downstream nozzle or an open passageway allowing free flow of fluid to the distal end. Where it is desired to discharge water, the valve is in the blocking position and pressurized water is supplied to the lance tube that is ejected from the smaller diameter upstream water discharge nozzles. A leakage flow of water is allowed to escape to the distal end of the lance tube for cooling purposes. When it is desired to discharge steam, the valve is set to provide an open flow passage, thus allowing steam supplied to the lance tube to reach the steam discharge nozzles at the distal end. The disadvantage of this approach is that a significant effort is necessary to change sootblowing media.

Yet another approach for dual media disclosure is described by U.S. Pat. No. 4,209,028 which is also assigned to the Assignee of this invention and is hereby incorporated by reference. This patent describes a sootblower lance tube having two sets of nozzles with one set being optimized for water discharge and the other for steam discharge. A thermostatically actuated valve system is employed to direct the flow of fluid to the two sets of nozzles. The theory of operation of the device is based on the fact that the supplied water is cooler than steam and thus a thermostatically sensitive element can be used to exploit this difference and actuate a valving system. This approach has not enjoyed widespread implementation in industry. This is likely attributable to the mechanical complexity of the system which must operate in a very hostile environment within the combustion device.

One common shortcoming of each of the approaches mentioned previously is their inability to allow the simultaneous discharge of two different types of cleaning media, such as steam and water.

In view of the foregoing, there is a need for a sootblower device which is readily adapted for discharging two types of cleaning media, where the change over from discharging one media to the other media can be made with minimal downtime of the sootblower device, and is made with mechanisms that will withstand the hot and corrosive environment experienced in the interior of a combustion device. Moreover, there is a need for such a device capable of simultaneous discharge of two types of cleaning media.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE PREFERRED EMBODIMENT

The following description of the preferred embodiments of the invention is not intended to limit the scope of the Invention to these preferred embodiments, but rather to enable any person skilled in the art to make and use the invention.

Figure 1:
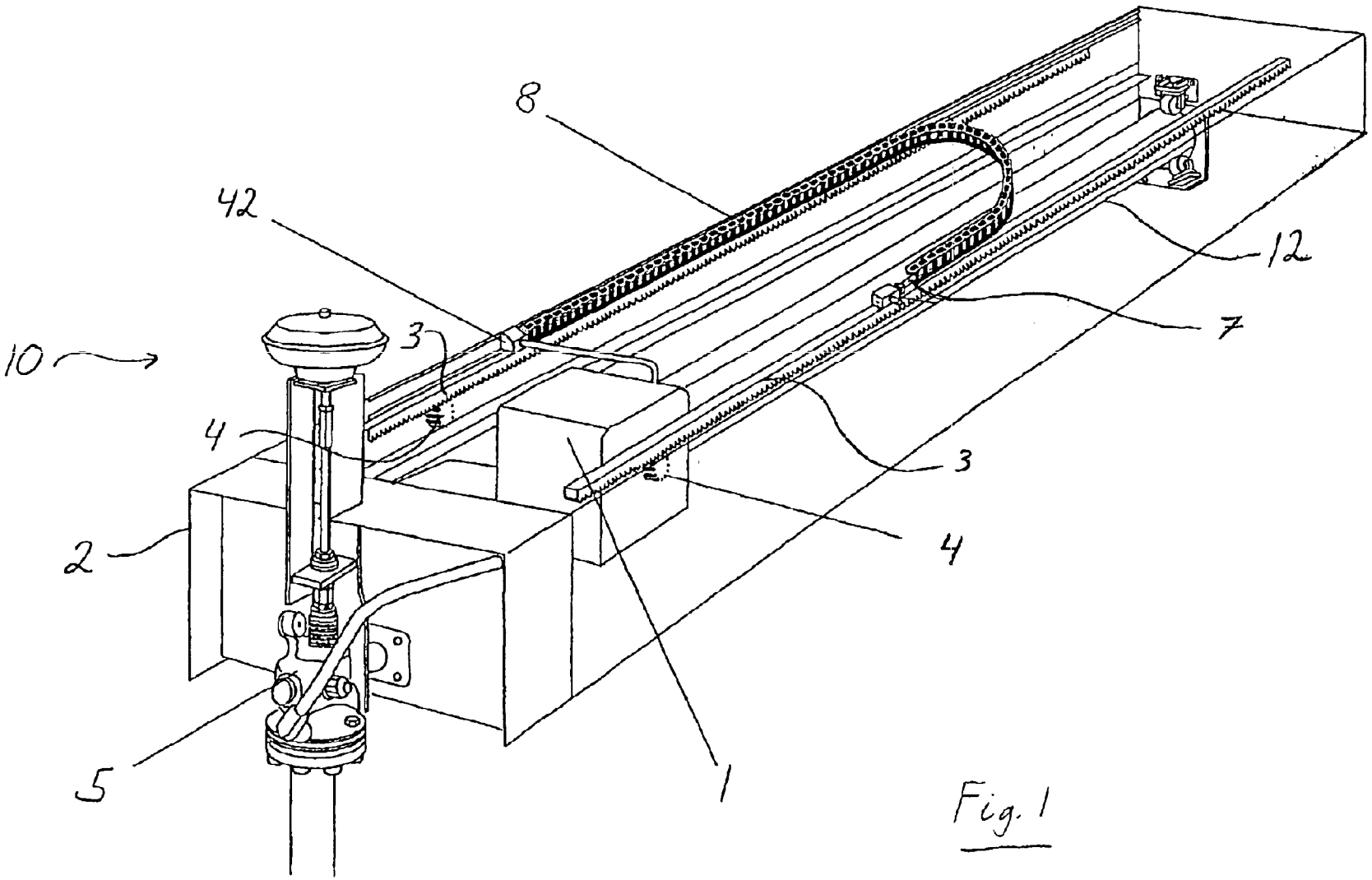
FIG. 1 is a pictorial view of a long retracting sootblower device, which is one type of sootblower device that may incorporate the novel features of the present invention.

Referring now to the drawings, a sootblower of the present invention is illustrated to clean heat exchange surfaces during movement of the lance tube assembly. A sootblower of the long retracting variety incorporating the features of the present invention is shown in FIG. 1 and designated generally by reference number 10. The sootblower 10 is generally of the type described in U.S. Pat. No. 3,439,376 commonly assigner to the Assignee of this invention and hereby incorporated by reference. Sootblowers of the general variety shown in FIG. 1, referred to as long retracting sootblowers, are well known within the art. As will become more apparent from the discussion which follows, the principles of the present invention will have applicability to sootblowers in general and are not limited to sootblowers of the particular variety illustrated.

A lance tube assembly 12 is mounted to a carriage assembly 1 and is reciprocally inserted into a heat exchanger to clean surfaces by discharging the cleaning media in a jet stream against the surfaces or into the narrow passages of the heat exchanger device. The carriage assembly 1 is supported by a frame box 2 which is in turn mounted to a wall box (not shown) of the heat exchanger. The frame box 2 forms a protective housing for the sootblower 10 exteriorly of the heat exchanger. To permit translational motion of the lance tube assembly 12, the carriage assembly 1 travels on rollers (not shown) between two pairs of tracks 3 (of which only the upper track of each pair is shown) which are rigidly connected to the frame box 2. The tracks 3 include toothed racks which are engaged by pinion gears 4 of the carriage assembly drive train to induce translation of the carriage assembly 1. A motor (not shown) is mounted to the carriage assembly 1. A drive train within the carriage assembly 1 s driven by the motor to rotate the pinion gears 4 causing the carriage assembly 1 to translate along the toothed racks 3 and thereby advance and retract the lance tube assembly 12 from the heat exchanger.

A flexible water supply hose 7 connects to the lance tube assembly 12 via an adaptor 42 affixed to the carriage assembly 1. A flexible cable carrier 8 is preferably employed to support the length of supply hose 7 necessary to provide for travel of the carriage assembly 1 along the length of the frame box 2. Steam, air, or other vapor or gas cleaning media is supplied by feed tube 60 (not shown in FIG. 1). The supply of such medium is controlled by poppet valve 5.

A programmable controller 11, which may be a common microprocessor may be used in some applications and is coupled to position sensors which provide information to the controller 11 regarding the translational position of the lance tube assembly 12. The controller 11 is programmed for the specific configuration of the heat exchanger surfaces that are to be cleaned. The controller 11 may be operable to control the translational speeds of the lance tube assembly 12 as well as the supply of the cleaning media. The controller 11 thus regulates the duration for which cleaning media is discharged from the lance tube 12 into the heat exchanger, the longitudinal position of the lance tube as a function of time, and the length of time it takes for the sootblower 10 to complete an entire operating cycle.

Figure 2:
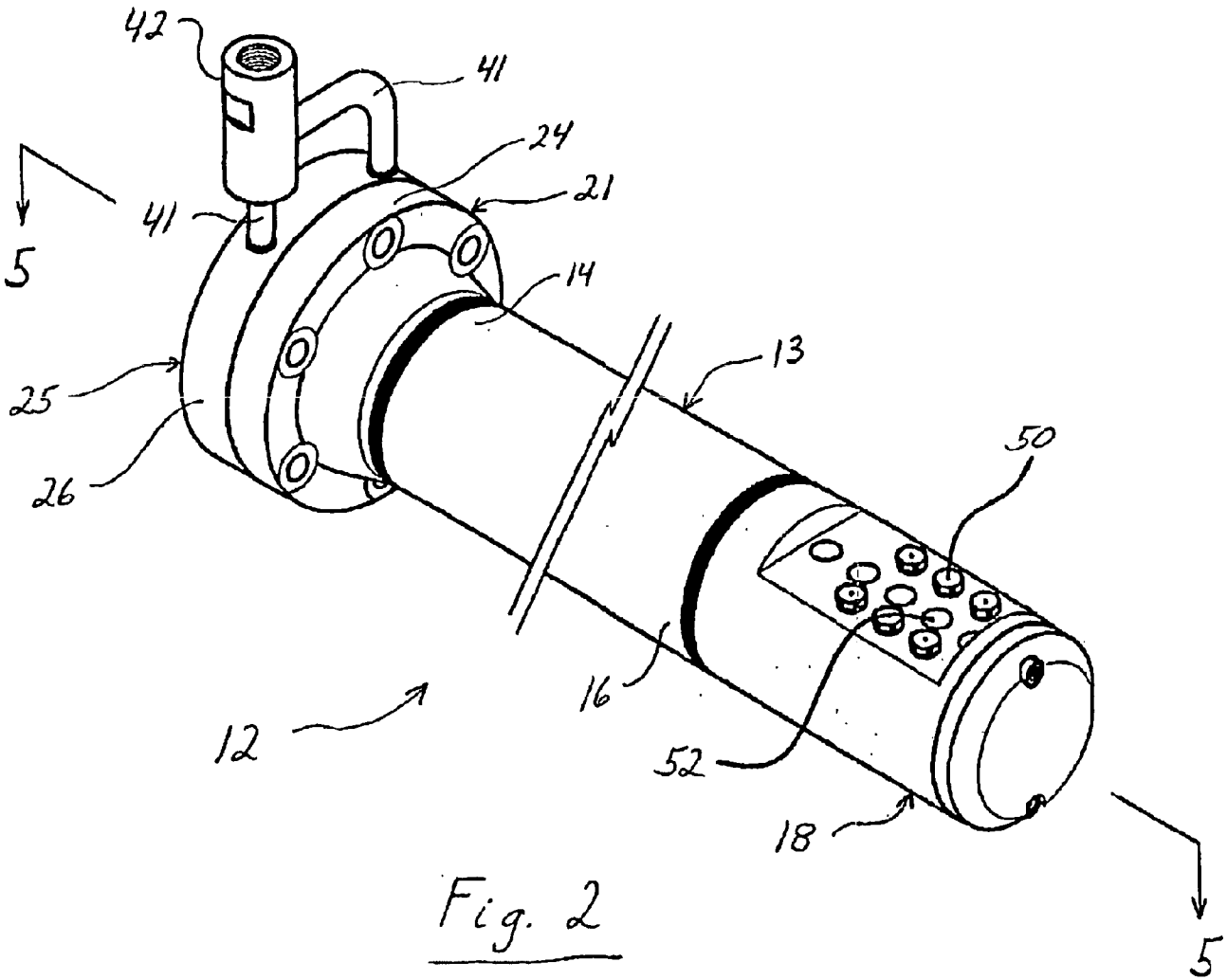
FIG. 2 is an isometric view of a lance tube assembly in accordance with a first embodiment of the present invention with a single nozzle assembly having nozzles for discharging different cleaning media.

Now referring to FIG. 2, the sootblower lance tube assembly 12 includes a tube section 13 having a first or proximal end 14 and a second or distal end 16, with a nozzle assembly 18 mounted to the second end 16 of the tube section 13. The nozzle assembly 18 has one or more nozzles adapted for directing a stream of cleaning media. The lance tube assembly 12 further Includes a hub 21 with a hub flange 24 mounted to the first end 14 of the tube section 13, and a manifold 25 mounted to the hub 21 distal from the tube section 13.

The nozzle assembly 18 includes one or more first nozzles 50 and one or more second nozzles 52. As shown in FIG. 2, the first nozzles 50 are laid out in two parallel rows of three, and a row of five second nozzles 52 is aligned parallel to and between the rows of first nozzles 50. Both the first and second nozzles 50, 52 are adapted for directing a stream of cleaning media. In the preferred embodiment, the first nozzles 50 are low dispersion water nozzles, and the second nozzles 52 are converging/diverging supersonic steam nozzles. Although the type of media dispersed through the first and second nozzles is arbitrary, the media dispersed through the first nozzles will always come from a source that Is unique and separate from the source supplying the second nozzles. It is to be understood that the arrangement of the nozzles 50, 52 and their configuration could be provided as appropriate for any particular application or preference. The descriptions of the nozzles 50, 52 and the arrangements herein are merely set forth as examples. The nozzle assembly 18 illustrated in FIG. 2 is shown rotated 180 degrees from the preferred orientation with respect to the hub 21.

Figure 3:
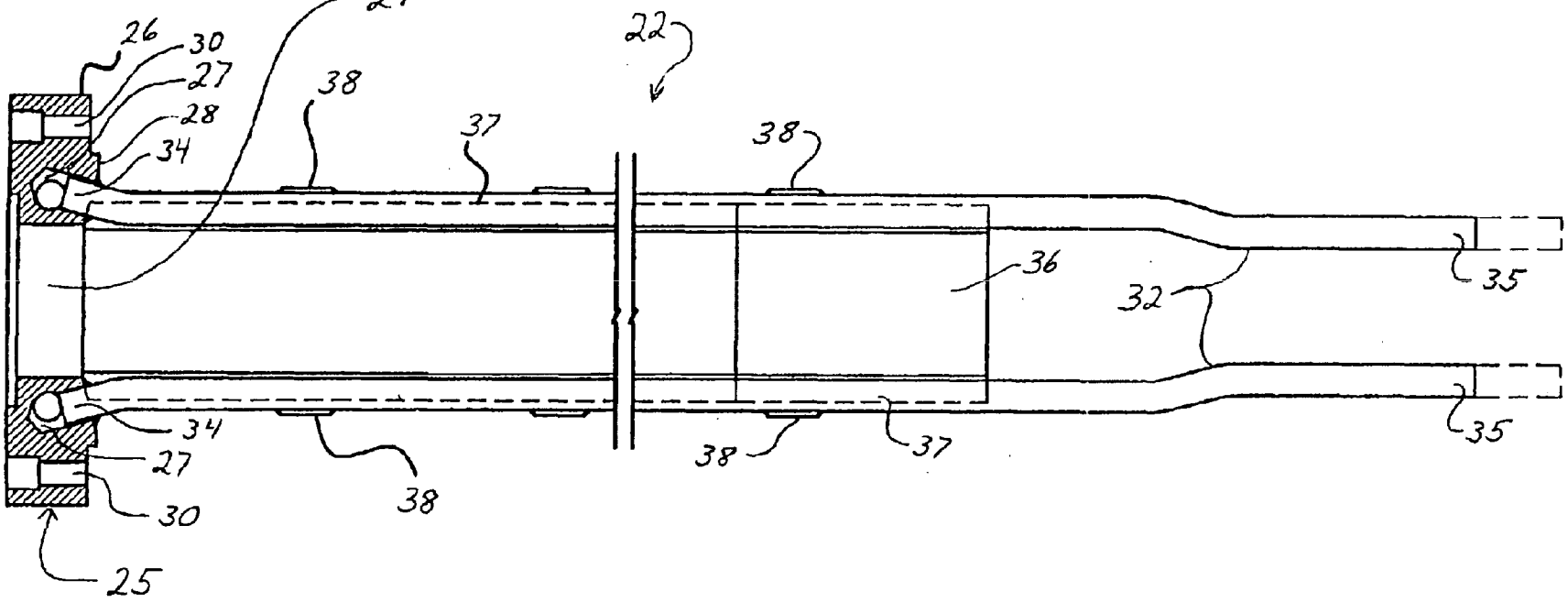
FIG. 3 is a plan view of a manifold and first high-pressure passage of the lance tube assembly shown in FIG. 2.

Now with reference to FIG. 3, the manifold 25 is generally annular and defines an outer diameter 26 and a front face 28. The manifold 25 further includes an opening 29 extending through the center of the manifold 25 and holes 30 drilled through the manifold 25 to allow the manifold 25 to be bolted to the hub 21. Protruding from the front face 28 of the manifold 25 is a pair of cylindrical tubes 32 extending perpendicularly from the front face 28 and parallel to each other. The cylindrical tubes 32 have first ends 34 and second ends 35, and the manifold 25 includes a pair of apertures 27, each aperture 27 adapted for receiving the first end 34 of one of the cylindrical tubes 32. The first ends 34 of the cylindrical tubes 32 are attached by brazing or welding within the apertures 27.

A shield assembly 36 extends from the front face 28 of the manifold 25 and runs parallel to the cylindrical tubes 32. The shield assembly 36 is mounted to the front face 28 of the manifold 25 by welding or some other suitable method. The shield assembly 36 is half-cylindrical In shape and includes a flared lip 37 along each lateral edge. The shield assembly 36 further includes clips 38 that hold the cylindrical tubes 32 to the shield assembly 36 so the tubes 32 are held between the flared lip 37 and the clips 38 to keep the cylindrical tubes 32 held securely to the shield assembly 36. The shield assembly 36 supports the cylindrical tubes 32. Due to the length of the cylindrical tubes 32 the second ends 35 would sag under the weight of the tubes 32 without support. The shield assembly 36 supports the cylindrical tubes 32 to keep the cylindrical tubes 32 perpendicular to the front face 28 of the manifold 25.

Figure 4:
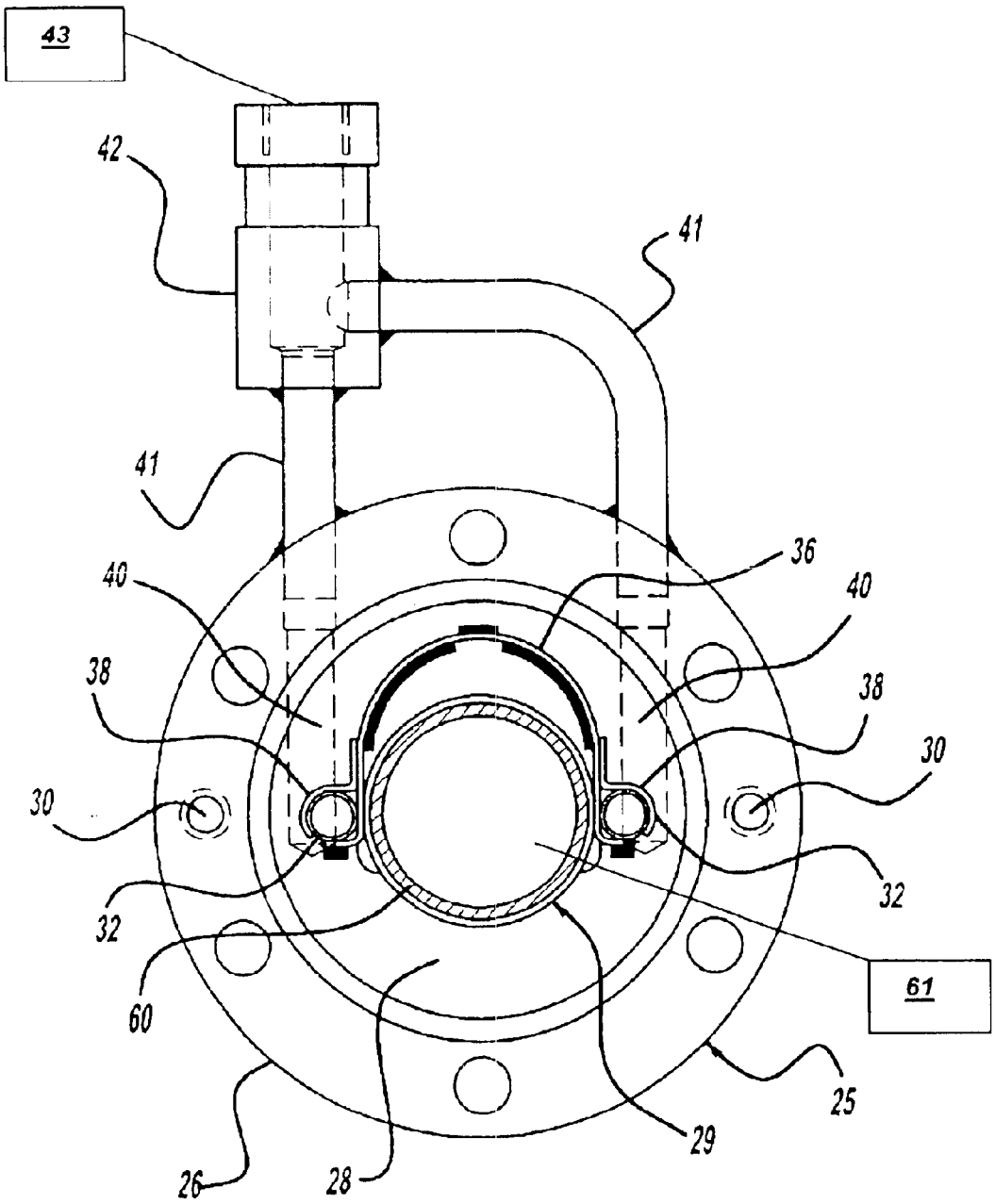
FIG. 4 is an end view of a cutaway lance tube also showing the feed tube extending within.

Referring to FIG. 4, the manifold 25 includes a pair of through penetrations 40 extending from the outer diameter 26 to the apertures 27 in the front face 28. A pair of adaptor tubes 41 extend from the through passages 40 to an adaptor 42 for connecting to an external source of cleaning media. The adaptor tubes 41 are permanently mounted to the manifold 25 by welding or brazing of some other suitable method. The cleaning media flows from the external source, through the adaptor 42 to the through penetrations 40 and into the first ends 34 of the cylindrical tubes 32. The adaptor 42, adaptor tubes 41, through penetrations 40, apertures 27, and the cylindrical tubes 32 define a first high pressure passage.

Figure 5:
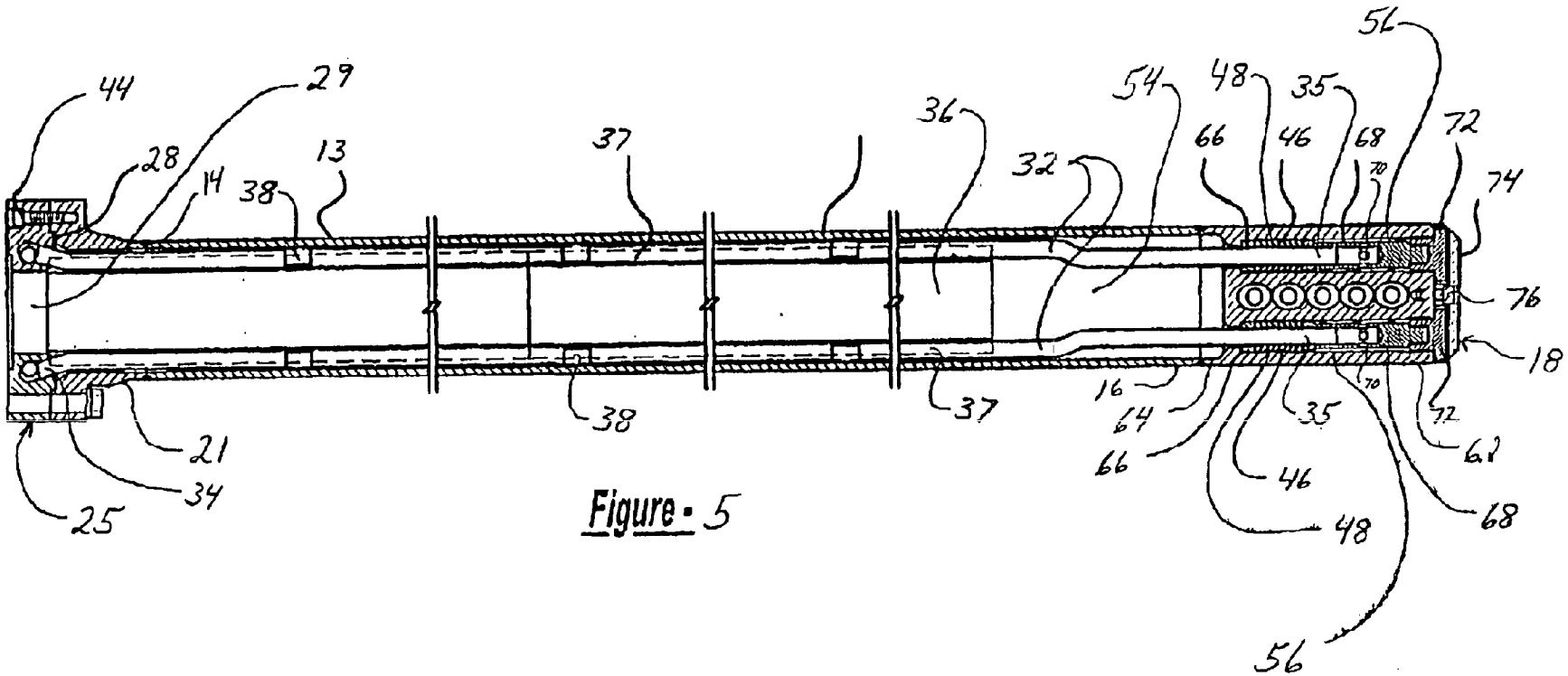
FIG. 5 is a cross-sectional view taken along lines 5—5 of FIG. 2.
Figure 6:
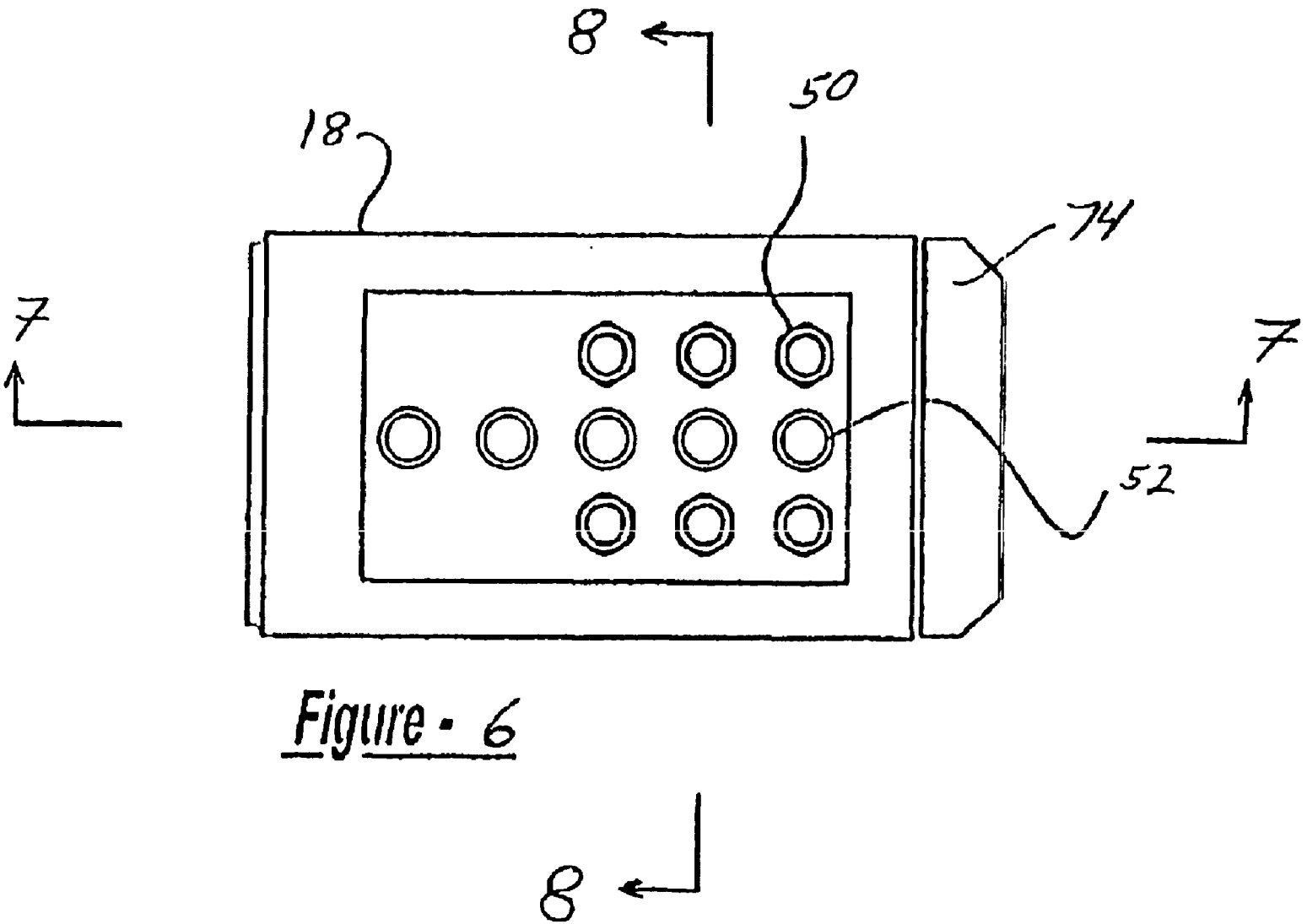
FIG. 6 is a top view of the nozzle assembly of the lance tube assembly shown in FIG. 2.

Referring to FIG. 5, the manifold 25 is mounted to the hub 21 at the second end of the tube section 13. The manifold 25 is held to the hub 21 by threaded fasteners 44 engaging the hub flange 24. The cylindrical tubes 32 extend from the manifold 25 into the hollow hub 21 and tube section 13 to the second end 16 of the tube section 13 where the second ends 35 of the cylindrical tubes 32 engage the nozzle assembly 18. The cylindrical tubes 32 are preferably fashioned from stainless steel, although it is to be understood that other materials could be used.

During operation of the sootblower device 10 the cylindrical tubes 32 are at a different temperature than the hub 21 and tube section 13 of the lance tube assembly 12 and will thermally expand and contract at different rates. The nozzle assembly 18 includes a seal assembly 46 for providing sealed sliding engagement between the second ends 35 of the cylindrical tubes 32 and the nozzle assembly 18. The seal assembly 46 includes a plurality of compressible rings 48, which are stacked together and compressed within the nozzle assembly 18. The stack of rings 48 forms a cylindrical seal with an opening extending through the center of the stack for receiving the second ends 35 of the cylindrical tubes 32. The second ends 35 of the cylindrical tubes 32 are received within the stack of rings 48 to form a seal between the rings 48 and the cylindrical tubes 32, while accommodating movement of the second ends 35 of the cylindrical tubes 32 relative to the nozzle assembly 18. It is to be understood, that the cylindrical tubes 32 could also be attached fixedly to the nozzle assembly 18 and moveably engaged to the manifold 25.

The nozzle assembly 18 includes one or more outer passages 56 in fluid communication with the first nozzles 50 for conducting cleaning media from the cylindrical tubes 32 of the first high pressure passage 22 to the first nozzles 50. In the preferred embodiment, the nozzle assembly 18 includes a pair of outer passages 56, one in fluid communication with each row of first nozzles 50. The second ends 35 of the cylindrical tubes 32 extend into the outer passages 56 to feed cleaning media to the first nozzles 50.

The nozzle assembly 18 includes a distal end 62 and a near end 64. The near end 64 of the nozzle assembly 18 is attached to the second end of the tube section 13. The outer passages 56 of the nozzle assembly 18 are through holes that extend between the near end 64 and distal end 62 of the nozzle assembly 18. Each of the outer passages 56 includes an inner shoulder 66 located adjacent to the near end 64. Each of the outer passages 56 also includes a plug 68 threadingly engaged within each outer passage 56 adjacent the distal end 62 of the nozzle assembly 18. The plugs 68 contain passages 70 for conducting cleaning media from the outer passages 56 to the first nozzles 50.

The rings 48 of the seal assembly 46 are made from a compressible material. In the preferred embodiment, the material that the rings 48 are made from is graphoil or Teflon, however the rings 48 could be made from any other suitable material. A number of the rings 48 are stacked on one another and placed within the outer passages 56 of the nozzle assembly 18 to rest against the inner shoulder 66 within each of the outer passages 56. The plug 68 is threaded into the outer passage 56 and compresses the rings 48 of the seal assembly 46 against the inner shoulder 66 of each of the outer passages 56. The second ends 35 of the cylindrical tubes 32 extend within the rings 48, and are allowed to slide back and forth within the stack of rings 48 while maintaining a sealed path from the cylindrical tubes 32, through the passages 70 in the plug 68, and to the first nozzles 50.

A cap 72 is placed against the end of each plug 68 after the plugs 68 have been threaded into the outer passages 56. The cap 72 extends out slightly beyond the distal end 62 of the nozzle assembly 18. A cover plate 74 is placed onto the distal end 62 of the nozzle assembly 18 to prevent the caps 72 from vibrating loose and to secure the plugs 68 in the outer passages 56. The cover 74 is held onto the distal end 62 of the nozzle assembly 18 by a pair of threaded fasteners 76. The cover 74 is removable by simply loosening the threaded fasteners 76 that hold it in place. In this way, the cap 72 can be removed and the plug 68 and seal assembly 46 can be accessed for repair or replacement.

The inner walls of the hub 21 and the tube section 13 of the lance tube assembly 12 define a second high pressure passage 54 for conducting cleaning media from an external source to the nozzle assembly 18.

Figure 7:
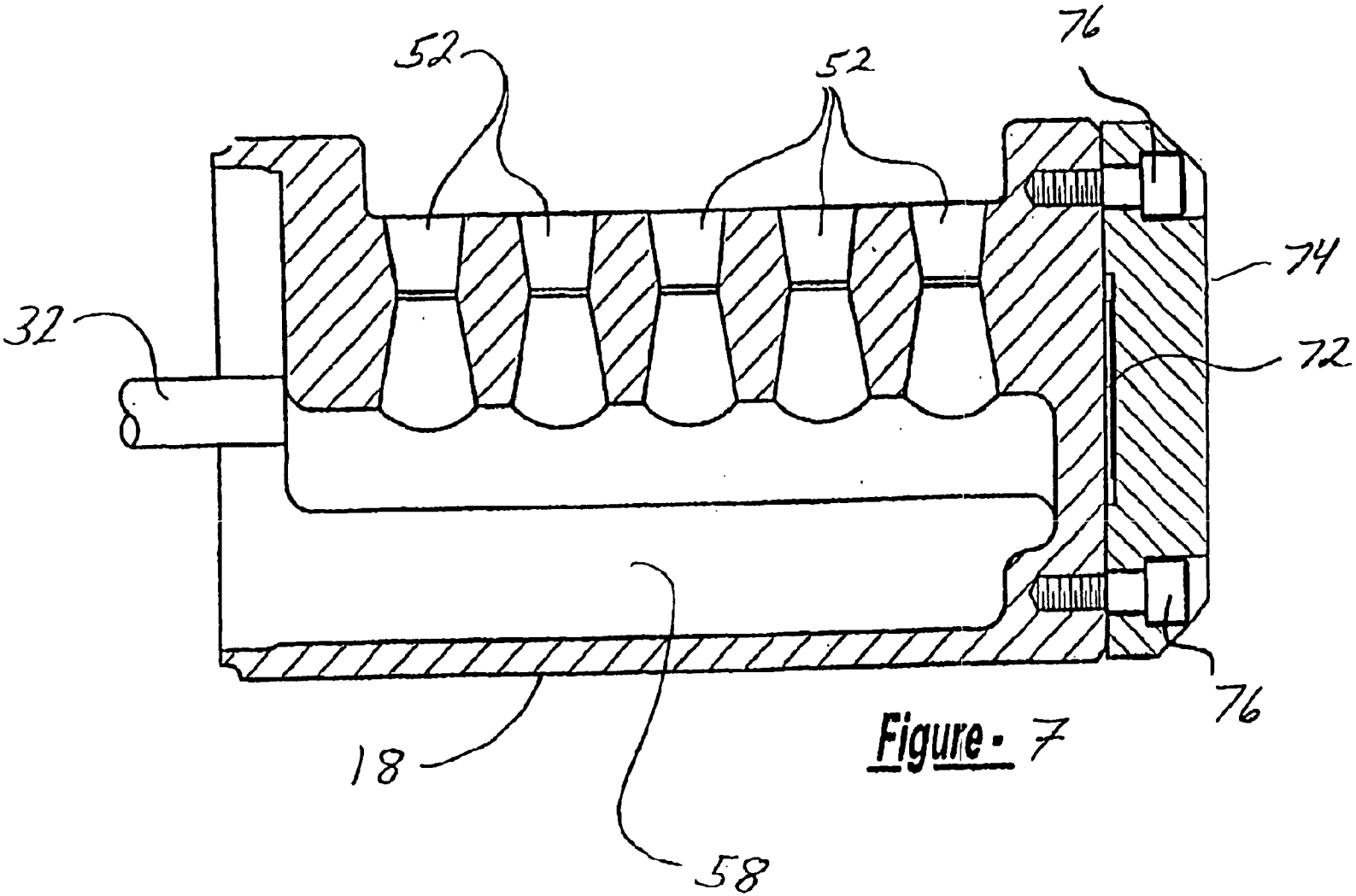
FIG. 7 is a cross-sectional view taken along lines 7—7 of FIG. 6.
Figure 8:
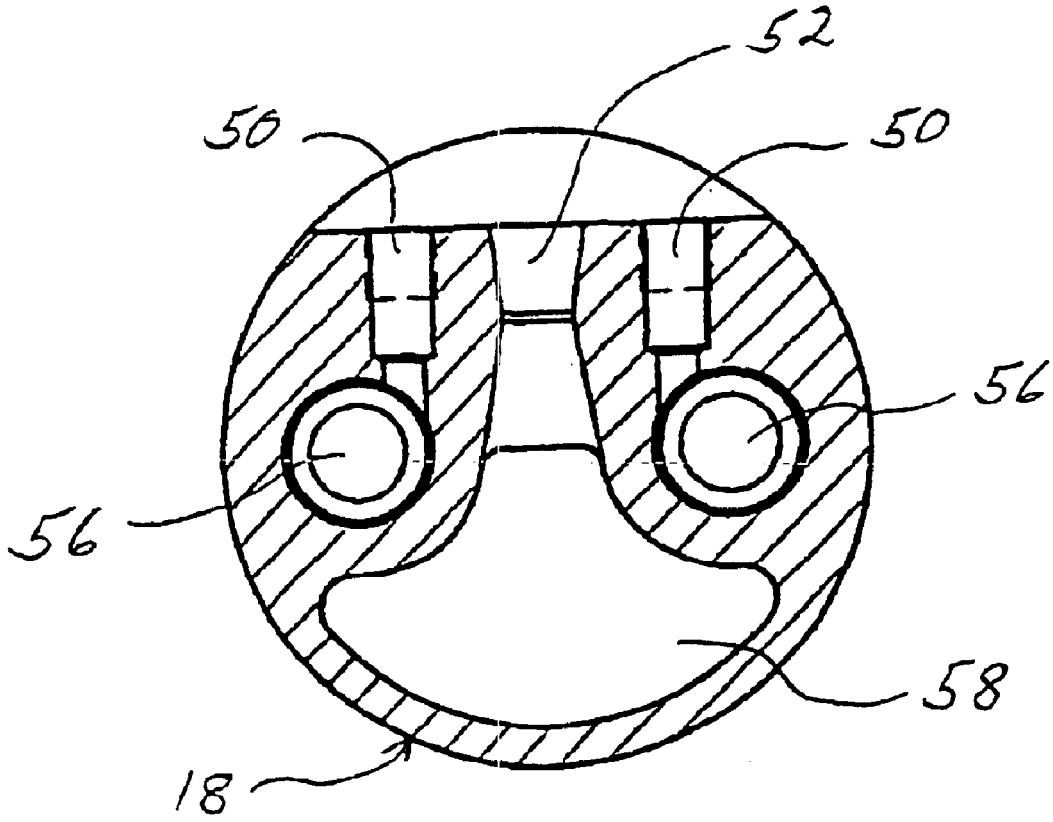
FIG. 8 is a cross-sectional view taken along lines 8—8 of FIG. 6.

Referring to FIGS. 7 and 8, The nozzle assembly 18 also includes a central passage 58 independent of the outer passages 56 and in fluid communication with the steam nozzles 52 for conducting steam from the second high pressure passage 54 to the steam nozzles 52.

The sootblower device 10 further includes a feed tube 60 for communicating cleaning media to the second high pressure passage 54. The feed tube 60 is mounted stationary with respect to the heat exchanger and the lance tube assembly 12 fits over the feed tube 60. The feed tube 60 is inserted within the lance tube assembly 12 through the opening 29 in the manifold 25. As the lance tube assembly 12 translates in and out of the heat exchanger, the feed tube 60 telescopes within the lance tube assembly 12. When the lance tube assembly 12 is fully extended into the heat exchanger, only the very tip of the feed tube 60 remains telescoped within the lance tube assembly 12. When the lance tube assembly 12 is withdrawn, substantially the entire length of the feed tube 60 is telescoped within the lance tube assembly 12, and the tip of the feed tube 60 extends to a point near the nozzle assembly 18. The feed tube 60 is also attached to an external source of cleaning media such as steam, and conducts the cleaning media to the second high pressure passage 54.

A packing gland (not shown) is positioned adjacent lance hub 21 to provide a fluid seal between feed tube 60 and lance tube assembly 12. Thus, steam or other cleaning media supplied by poppet valve 5, transmitted through feed tube 60 flows through nozzles 52.

Referring again to FIG. 4, another function of the shield assembly 36 is to guard the cylindrical tubes 32 from being damaged by the feed tube 60 when the feed tube 60 extends into the lance tube assembly 12. The shield assembly 36 is designed to hold the cylindrical tubes 32 within the tube section 13 of the lance tube assembly 12 to prevent the cylindrical tubes 32 from sagging under their own weight when filled with cleaning media. The weight of the cylindrical tubes 32, particularly when filled with cleaning media, would otherwise cause the cylindrical tubes 32 to sag and come into close proximity or into contact with the feed tube 60. The cylindrical tubes 32 are held to the shield assembly 36 at several points by clips 38 spot-welded to the shield assembly 36. The distal end of the feed tube 60 is unsupported as it strokes in and out of the lance tube assembly 12 as the lance tube assembly 12 is inserted and retracted from the heat exchanger. The distal end of the feed tube 60 drags along the bottom of tube section 13 of the lance tube assembly 12 whenever the feed tube 60 is protruding into the lance tube assembly 12 by more than a few feet. The front end of the feed tube 60 has the potential to damage the cylindrical tubes 32 if they are not protected by the shield assembly 36. Scraping contact with the feed tube 60 would snag the cylindrical tubes 32 and dislodge them from the nozzle assembly 18 or the manifold 25, thus interrupting the flow of cleaning media to the nozzles 50.

The interior of the lance tube assembly 12 defines the second fluid pressure passage 54 and conducts the cleaning media from the feed tube 60 to the nozzle assembly 18. The second fluid pressure passage 54 feeds the central passage 58 of the nozzle assembly 18 to conduct the cleaning media to the steam nozzles 52. The central passage 58 ends within the nozzle assembly 18 so all the cleaning media is forced out through the nozzles 52.

A second embodiment of a lance tube assembly 12*a* which includes more than one nozzle assembly 18 is shown in FIGS. 9 through 14.

Figure 9:
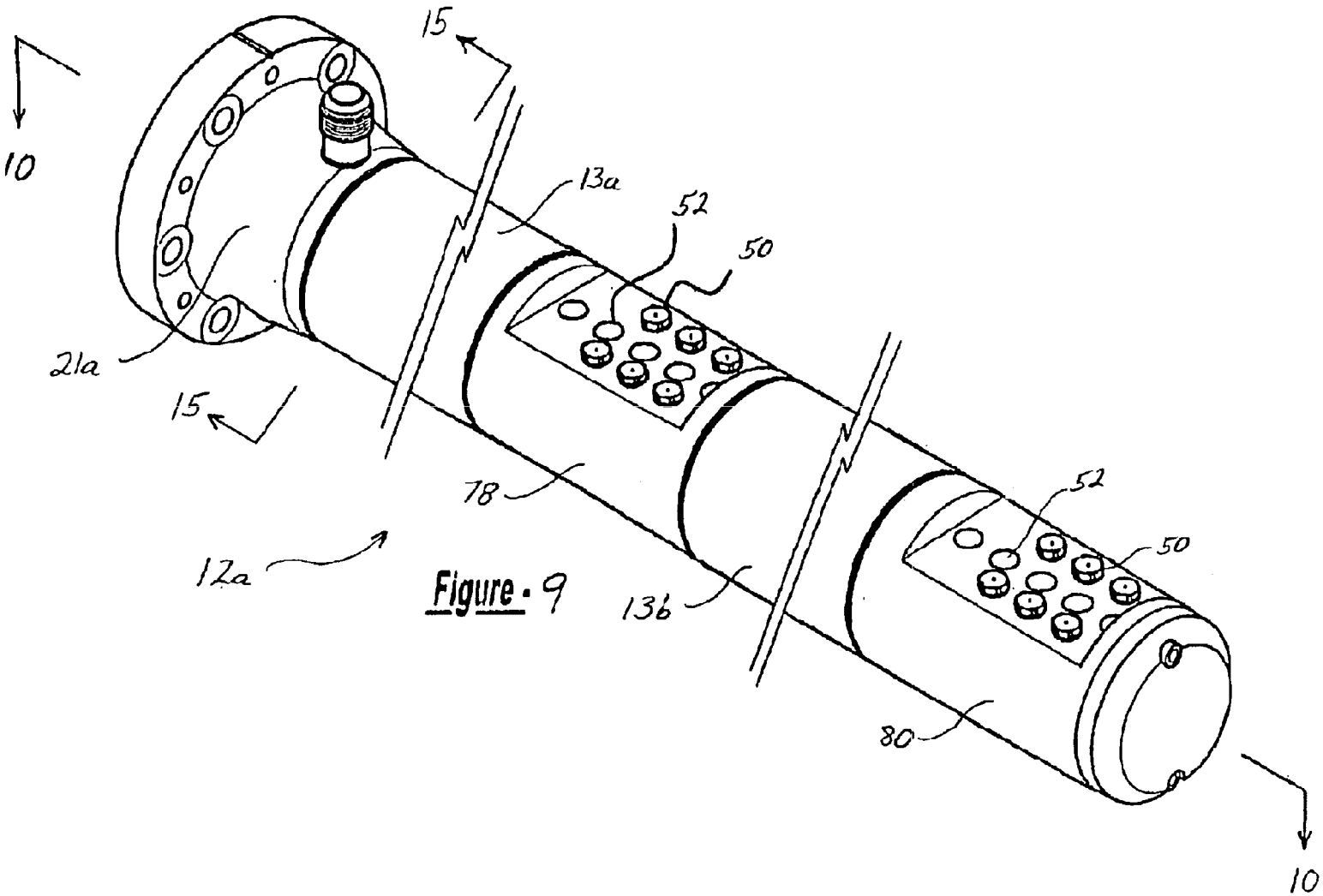
FIG. 9 is an isometric view of a lance tube assembly in accordance with a second embodiment of the present invention with dual nozzle assemblies, each having nozzles for discharging different cleaning media.

Referring to FIG. 9, the alternative embodiment includes a lance tube assembly 12*a* having a hub 21*a,* a pair of tube sections 13*a,* 13*b,* and a pair of nozzle assemblies 78 and 80. A first tube section 13*a* is mounted to the hub 21*a*. A first nozzle assembly 78 is mounted to the end of the first tube section 13*a* opposite the hub 21*a*. A second tube section 13*b* is mounted to the first nozzle assembly 78 opposite the first tube section 13*a*. A second nozzle assembly 80 is mounted to the second tube section 13*b* opposite the first nozzle assembly 78. Each of the first and second nozzle assemblies 78, 80 include one or more nozzles 50, 52 adapted for directing a stream of cleaning media into the passages inside the heat exchanger.

Figure 10:
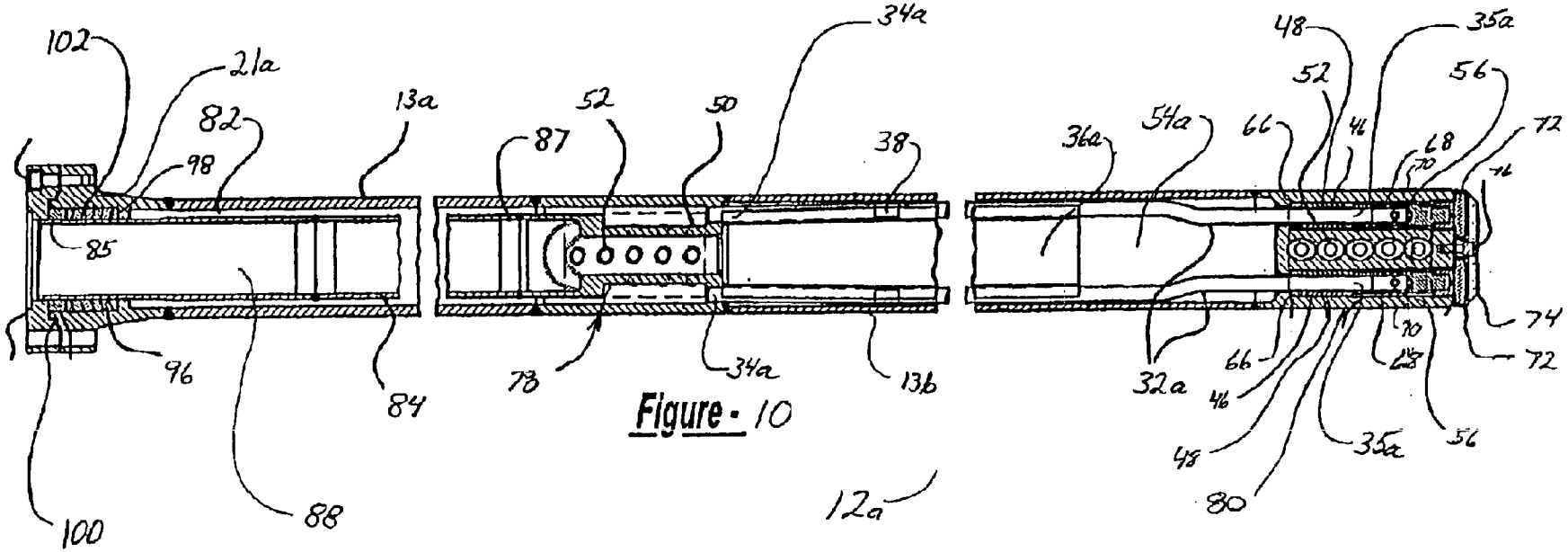
FIG. 10 is a cross-sectional view taken along lines 10—10 of FIG. 9.

Now referring to FIG. 10, the alternative lance tube assembly 12*a* includes a first high pressure passage for conducting cleaning media from the first nozzle assembly 78 to the second nozzle assembly 80 and a second high pressure passage 82 for conducting cleaning media from the hub 21*a* to the first nozzle assembly 78. Specifically, the first high pressure passage shown as a pair of stainless steel cylindrical tubes 32*a* with a first ends 34*a* and a second ends 35*a,* as described above, where the first ends 34*a* of the cylindrical tubes 32*a* are permanently mounted to the first nozzle assembly 78 by brazing, welding, or some other suitable method, and the second ends 35*a* of the cylindrical tubes 32*a* are slidably engaged with the second nozzle assembly 80 in the same manner as described for the preferred embodiment above. A shield assembly 36*a* is attached to and extends from the upstream nozzle assembly 80 to support and protect the cylindrical tubes 32*a*. However, in this embodiment, tubes 32*a* are not exposed to contact with the feed tybe.

The second embodiment 12*a* includes a hollow cylindrical sleeve 84 extending between the hub 21*a* and the first nozzle assembly 78. The sleeve 84 has a diameter smaller than the first tube section 13*a,* thereby leaving an annular space between the inner wall of the lance tube 12 and the external wall of the sleeve 84. The second high-pressure passage 82 is defined by this annular space.

Each of the first and second nozzle assemblies 78, 80 include one or more nozzles of a first type 50 and one or more nozzles of a second type 52. Both the first and second nozzles 50, 52 are adapted for directing a stream of cleaning media. As in the first embodiment described previously, the first nozzles 50 are low dispersion water nozzles, and the second nozzles 52 are converging/diverging supersonic steam nozzles. It is to be understood, that the arrangement of the nozzles 50, 52 and the type of nozzles 50, 52 could be as is appropriate for any particular application or preference. The descriptions of the nozzles 50, 52 and the arrangements herein are merely set forth as example.

The second embodiment of lance tube assembly 12*a* further includes a third high-pressure passage 88 for conducting cleaning media from an external source to the first nozzle assembly 78. The third high-pressure passage 88 is defined by the inner wall of the sleeve 84. The sleeve 84 is permanently mounted to the first nozzle assembly 78 at one end, and sealed to the hub 21*a* at the other end, thereby keeping the second high pressure passage 82 and third high pressure passage 88 independent of each other.

During operation of lance tube assembly 12*a* the sleeve 84 is at a different temperature than the hub 21*a* and the first tube section 13*a* and will thermally expand and contract different amounts. The sleeve 84 includes a first end 85 and a second end 87. The second end 87 is permanently mounted to the first nozzle assembly 78 by brazing, welding, or other suitable means. The first end 85 of the sleeve 84 engages the hub 21*a*. The hub 21*a* includes a sleeve seal assembly 96 for providing sealed sliding engagement between the first end 85 of the sleeve 84 and the hub 21*a* while accommodating movement of the first end 85 of the sleeve 84 relative to the hub 21*a*. It is to be understood, that the sleeve 84 could be mounted fixedly to the manifold 25 and moveably engaged with the first nozzle assembly 78. The feed tube 60 slides within sleeve 84.

The hub 21*a* includes an annular inner shoulder 98, and the manifold 25*a* includes a raised annular face 100. The sleeve seal assembly 96 includes a number of rings 102 of a compressible material, preferably graphoil or Teflon, however, other suitable material could be used. The rings 102 are stacked upon one another and placed within the hub 21*a* to rest against the annular inner shoulder 98. When the manifold 25*a* is placed to the hub 21*a,* the rings 102 are compressed between the annular inner shoulder 98 and the raised annular face 100 of the manifold 25*a*. The first end 85 of the sleeve 84 extends within the rings 102, and is allowed to slide back and forth within the stack of rings 102 while maintaining a sealed path from the feed tube 60 to the third high pressure passage 88.

The second nozzle assembly 80 includes one or more outer passages 56 in fluid communication with the first nozzles 50 for conducting cleaning media from the cylindrical tubes 32*a* to the first nozzles 50, and a central passage 58 in fluid communication with the second nozzles 52 for conducting cleaning media from the fourth high pressure passage 54*a* to the second nozzles 52. The second nozzle assembly 80 of the second embodiment 12*a* is identical to the nozzle assembly 18 of the preferred embodiment 12 as described above.

Figure 11:
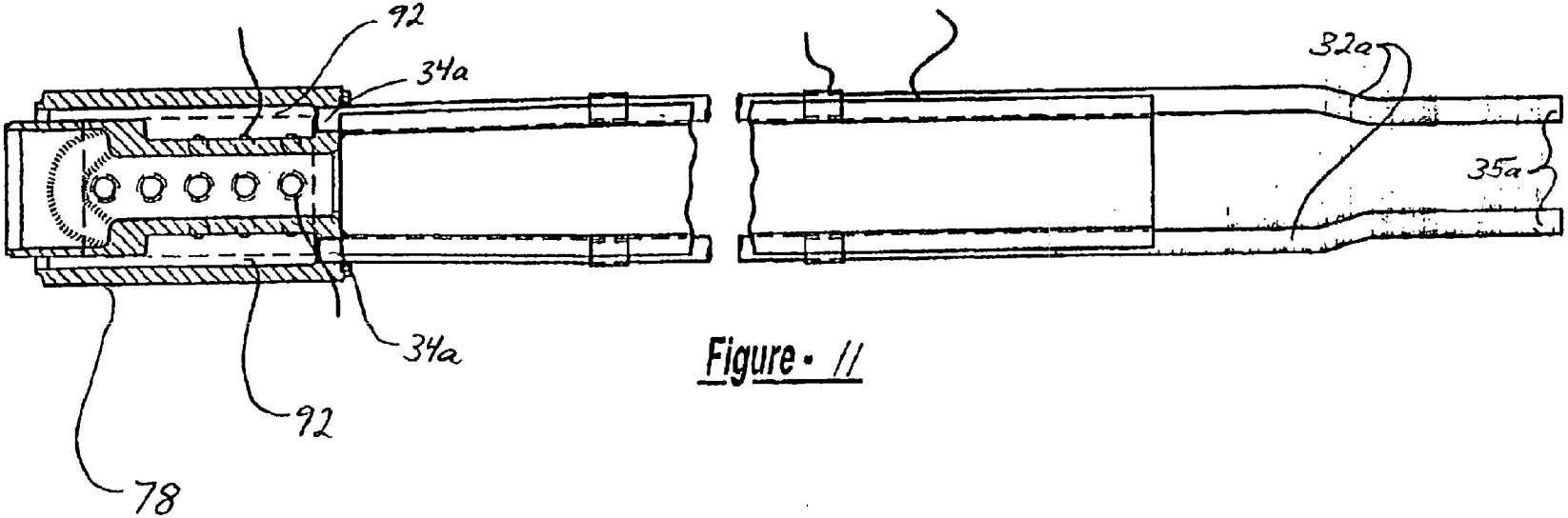
FIG. 11 is a cross-sectional view taken along lines 10—10 of FIG. 9 showing only the upstream nozzle assembly and the conduits.
Figure 12:
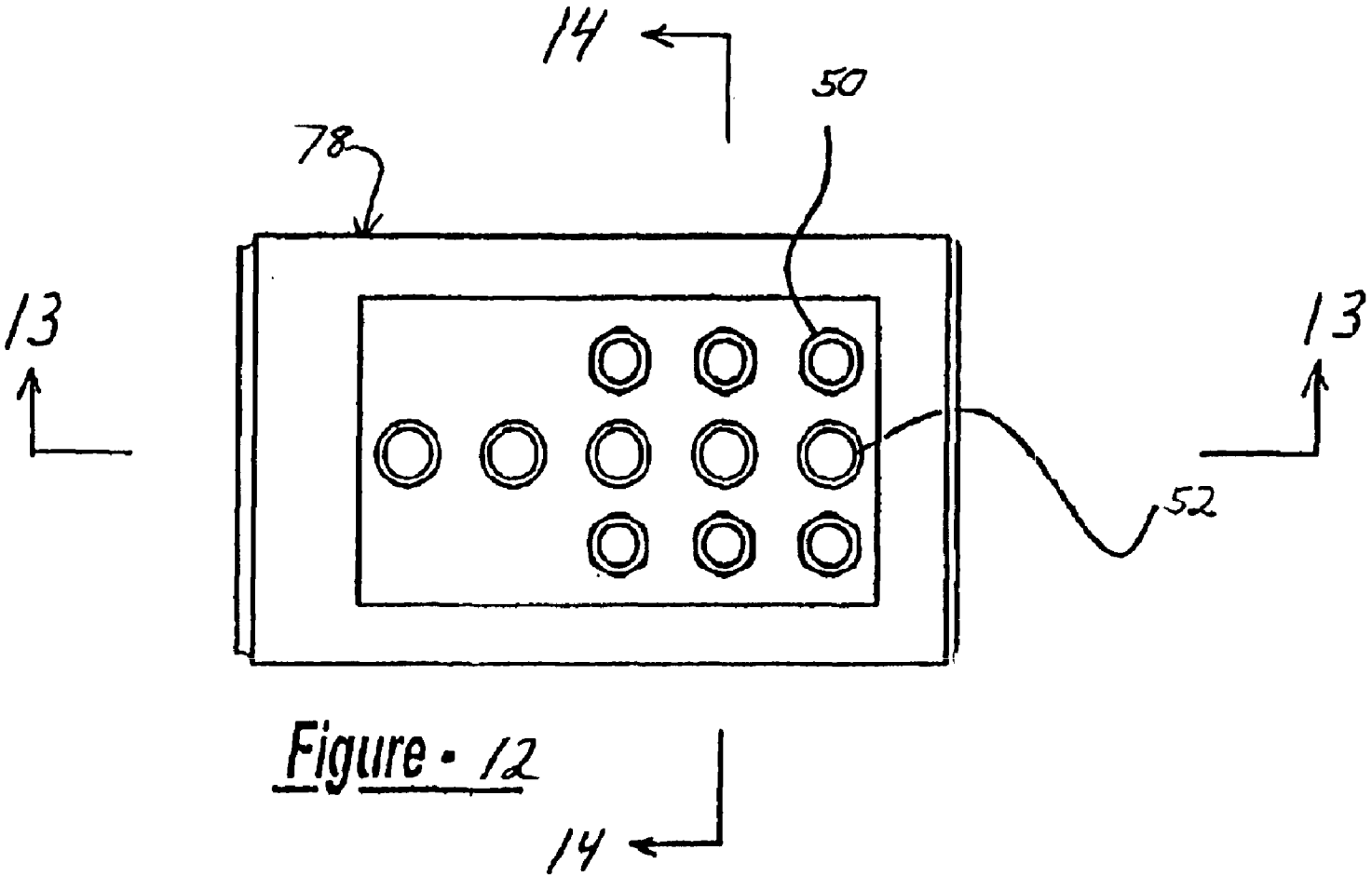
FIG. 12 is a top view of the upstream nozzle assembly of the second embodiment.

Now referring to FIG. 11, the first nozzle assembly 78 includes one or more outer passages 92 in fluid communication with the water nozzles 50 and the cylindrical tubes 32*a* for conducting cleaning media from the second high pressure passage 82 to the water nozzles 50 and to the cylindrical tubes 32*a*.

In operation, water enters the lance tube assembly 12 through the second high pressure passage 82, is fed to the first nozzle assembly 78 where some of the water is forced through the water nozzles 50 and the remaining water is conducted through the outer passages 92 to the first ends 34*a* of the cylindrical tubes 32*a* to be conducted to the water nozzles 50 of the second nozzle assembly 80.

Figure 15:
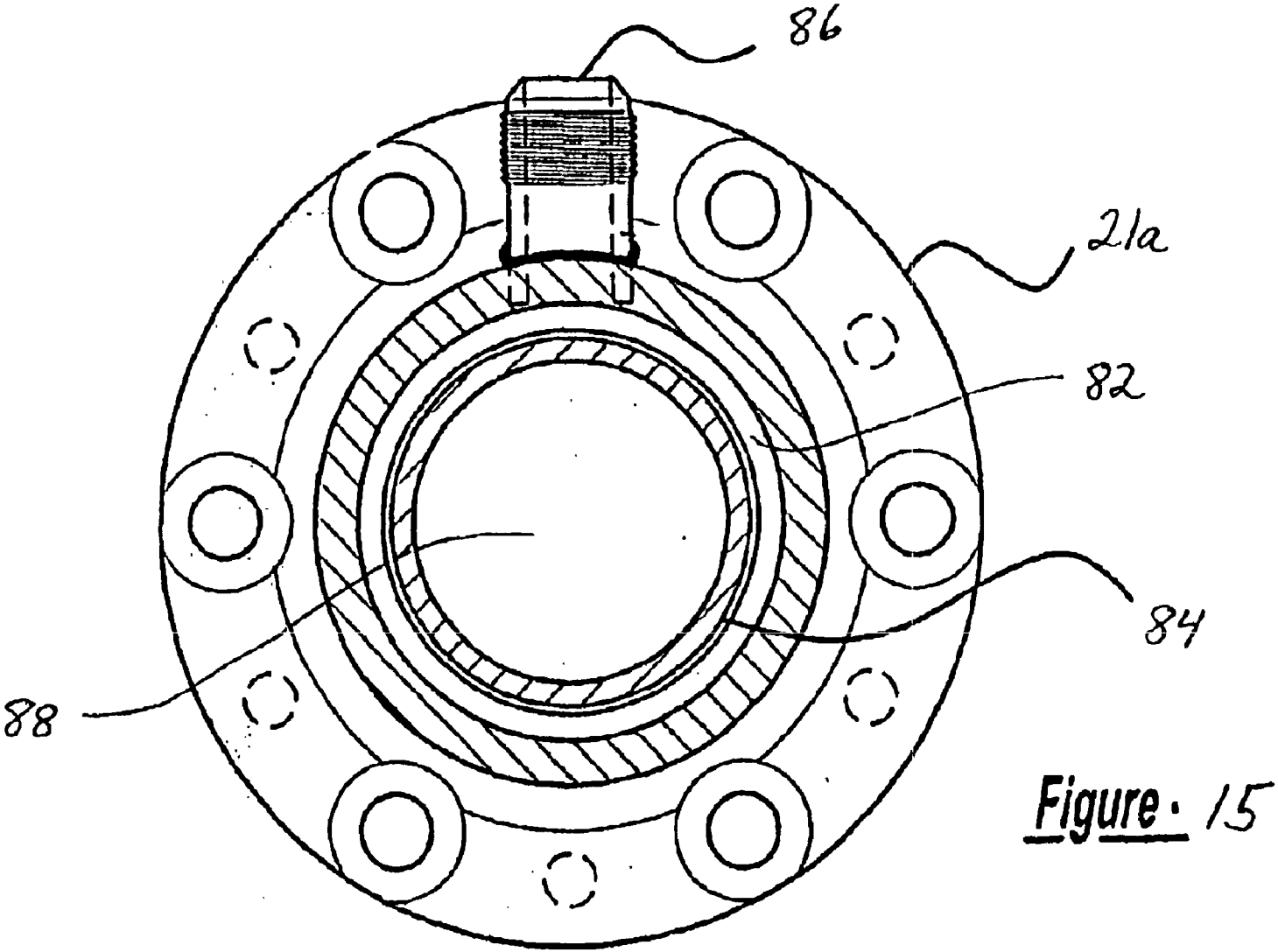
FIG. 15 is a cross-sectional view taken along lines 15—15 of FIG. 9.

Referring to FIG. 15, the hub 21*a* includes an aperture 86 for connecting the second high-pressure passage 82 to an external supply of cleaning media, preferably water.

Figure 13:
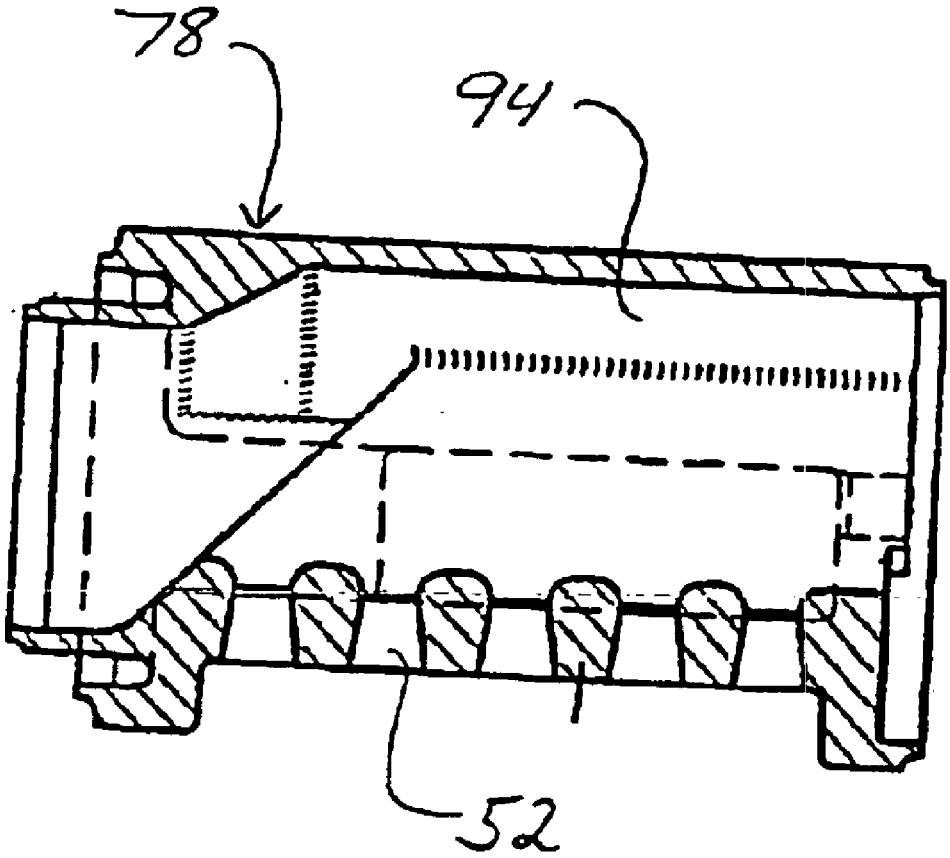
FIG. 13 is a cross-sectional view taken along lines 13—13 of FIG. 12.
Figure 14:
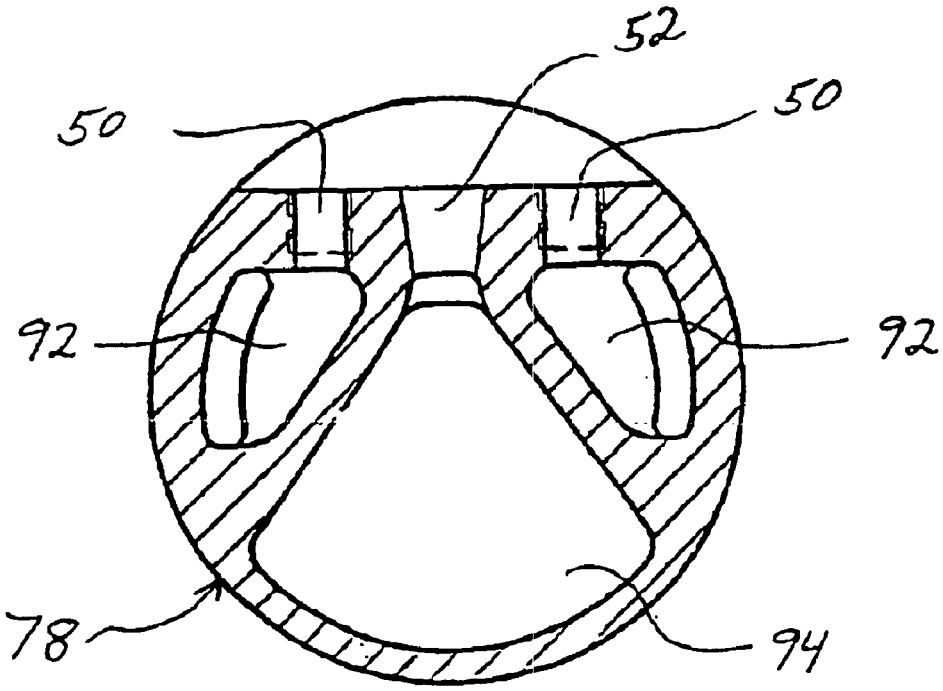
FIG. 14 is a cross-sectional view taken along lines 14—14 of FIG. 12.

Now referring to FIGS. 13 and 14, the first nozzle assembly 78 further includes a central passage 94 in fluid communication with the second nozzles 52 and the fourth high pressure passage 54*a* for conducting cleaning media from the third high pressure passage 88 to the steam nozzles 52 and to the fourth high pressure passage 54*a*. A feed tube 60, the same as described above for the preferred embodiment, supplies steam to the third high-pressure passage 88. The feed tube 60 is mounted stationary with respect to the heat exchanger and telescopes within the third high pressure passage 88 as the lance tube assembly 12*a* is stroked back and forth within the heat exchanger. In operation, steam is supplied to the third high-pressure passage 88 and flows to the central passage 94 in the first nozzle assembly 78. Some of the steam is forced out the steam nozzles 52 in the first nozzle assembly 78, and the remaining steam is forced though the central passage 94 into the fourth high pressure passage 54*a* to be conducted to the steam nozzles 52 of the second nozzle assembly 80.

The invention has been described in an illustrative manner, and it is to be understood that the terminology that has been used is intended to be in the nature of words of description rather than of limitation.

Obviously, many modifications and variations of the present invention are possible in light of the above teachings. It is, therefore, to be understood that the invention may be practiced otherwise than as specifically described.

What is claimed is:

1. A long retracting sootblower device for conducting a plurality of cleaning media types to an interior of a heat exchanger, the sootblower device having a lance tube assembly, a feed tube, a carriage assembly for moving the lance tube assembly relative to the feed tube, a first cleaning media supply, and a second cleaning media supply, wherein said lance tube assembly comprises:

a hub assembly in fluid communication with said first cleaning media supply, a tube section extending outward from said hub;

a nozzle assembly mounted to a distal end of said tube section, said nozzle assembly including one or more nozzles adapted for directing a stream of cleaning media into the narrow passages of said heat exchanger;

said hub assembly including at least one cylindrical tube with a first end and a second end, said first end of said cylindrical tube being mounted to said hub assembly, and said second end of said cylindrical tube engaging said nozzle assembly, said hub assembly and said cylindrical tube defining a first high pressure passage for conducting cleaning media from said first cleaning media supply to said nozzle assembly; and said hub assembly further including a shield assembly for supporting said cylindrical tube within said tube section.

2. The sootblower device as set forth in claim 1, wherein said nozzle assembly includes a seal assembly for providing sealed sliding engagement between said second end of said cylindrical tube and said nozzle assembly while accommodating movement of said second end of said cylindrical tube relative to said nozzle assembly.

3. The sootblower device as set forth in claim 2, wherein said nozzle assembly includes one or more first nozzles and one or more second nozzles, both said first and second nozzles being adapted for directing a stream of cleaning media.

4. The sootblower device as set forth in claim 3, further including a second high pressure passage for conducting cleaning media from said second cleaning media supply to said nozzle assembly;

said nozzle assembly including one or more outer passages in fluid communication with said first nozzles for conducting cleaning media from said first high pressure passage to said first nozzles, and a central passage in fluid communication with said second nozzles for conducting cleaning media from said second high pressure passage to said second nozzles.

5. The sootblower device as set forth in claim 4, wherein said hub and tube section of said lance tube assembly are cylindrical in shape and hollow, and said second high pressure passage being defined by the inner walls of said hub and said tube section of said lance tube assembly.

6. The sootblower device as set forth in claim 5, including a feed tube for communicating cleaning media from said second cleaning media supply to said second high pressure passage, wherein said feed tube is mounted stationary with respect to the heat exchanger and telescopes within said lance tube assembly as said lance tube assembly is stroked into and retracted from the heat exchanger.

7. The sootblower device as set forth in claim 6, wherein said nozzle assembly includes a distal end and a near end, said near end being attached to said tube section, said outer passage of said nozzle assembly extending between said near end and said distal end through said nozzle assembly and including an inner shoulder located adjacent said near end and a plug threadingly engaged within said outer passage adjacent said distal end, said plug including passages for conducting cleaning media to said first nozzles, said seal assembly comprising rings of a compressible material which are stacked and compressed between said inner shoulder and said plug.

8. The sootblower device as set forth in claim 7, including a removable cover plate mounted to said distal end of said nozzle assembly for removably securing said plug within said outer passage.

9. The sootblower device as set forth in claim 8, wherein said manifold includes an adaptor for connecting to said first cleaning media supply.

10. The sootblower device as set forth in claim 9, wherein said first nozzles are low dispersion water nozzles, and said second nozzles are converging/diverging steam nozzles.

11. A long retracting sootblower device for conducting a plurality of cleaning media types to an interior of a heat exchanger, the sootblower device having a lance tube assembly, a feed tube, a carriage assembly, a first cleaning media supply, and a second cleaning media supply, wherein said lance tube assembly comprises:

a manifold for adapting to said first cleaning media supply, a hub mounted to said manifold, a first tube section extending outward from said hub, a first nozzle assembly mounted to a distal end of said tube section, a second tube section mounted to said first nozzle assembly opposite said first tube section, and a second nozzle assembly mounted to a distal end of said second tube section;

each of said nozzle assemblies including one or more nozzles adapted for directing a stream of cleaning media into the internal passages of said heat exchanger;

said first nozzle assembly having at least one cylindrical tube with a first end and a second end, said first end of said cylindrical tube being permanently mounted to said first nozzle assembly, and said second end of said cylindrical tube engaging said second nozzle assembly, said cylindrical tube defining a first high pressure passage for conducting cleaning media from said first nozzle assembly to said second nozzle assembly;

said first nozzle assembly further including a shield assembly extending therefrom for supporting said cylindrical tube within said second tube section.

said lance tube assembly further including a second high pressure passage for conducting cleaning media from said first cleaning media supply to said first nozzle assembly.

12. The sootblower device as set forth in claim 11, including a cylindrical sleeve extending between said manifold and said first nozzle assembly, said sleeve having a diameter smaller than said hub and said tube section, wherein said second high pressure passage is defined by the annular space between an inner wall of said lance tube and an external wall of said sleeve.

13. The sootblower device as set forth in claim 12, wherein said second nozzle assembly includes a seal assembly for providing sealed sliding engagement between said second end of said cylindrical tube and said second nozzle assembly while accommodating movement of said second end of said cylindrical tube relative to said second nozzle assembly.

14. The sootblower device as set forth in claim 13, wherein each of said first and second nozzle assemblies include one or more first nozzles and one or more second nozzles, said first and second nozzles being adapted for directing a stream of cleaning media.

15. The sootblower device as set forth in claim 14, further including a third high pressure passage for conducting cleaning media from said second cleaning media supply to said first nozzle assembly, said third high pressure passage defined by the inner wall of said sleeve;

said second nozzle assembly including one or more outer passages in fluid communication with said first nozzles for conducting cleaning media from said cylindrical tube to said first nozzles, and a central passage in fluid communication with said second nozzles for conducting cleaning media from a fourth high pressure passage to said second nozzles;

said first nozzle assembly including one or more outer passages in fluid communication with said first nozzles and said cylindrical tube for conducting cleaning media from said second high pressure passage to said first nozzles and said cylindrical tube, and a central passage in fluid communication with said second nozzles and said fourth high pressure passage for conducting cleaning media from said third high pressure passage to said secondary nozzles and said fourth high pressure passage.

16. The sootblower device as set forth in claim 15, including a feed tube for communicating cleaning media from said second cleaning media supply to said third high pressure passage, wherein said feed tube is mounted stationary with respect to the heat exchanger and telescopes within said third high pressure passage as said lance tube is stroked into and retracted from the heat exchanger.

17. The sootblower device as set forth in claim 16, wherein said second nozzle assembly includes a distal end and a near end, said near end being mounted to the distal end of said second tube section, said outer passage of said second nozzle assembly extending between said near and distal ends through said second nozzle assembly and including an inner shoulder located adjacent said near end of said second nozzle assembly and a plug threadingly engaged within said outer passage adjacent said distal end of said second nozzle assembly, said plug including passages for conducting cleaning media to said first nozzles, and said seal assembly comprising rings of a compressible material which are stacked and compressed between said inner shoulder and said plug.

18. The sootblower device as set forth in claim 17, including a removable cover plate mounted to said distal end of said second nozzle assembly for removably securing said plug within said outer passage of said second nozzle assembly.

19. The sootblower device as set forth in claim 18, wherein said hub includes an adaptor for connecting said second high pressure passage to said first cleaning media supply.

20. The sootblower device as set forth in claim 19, wherein said sleeve includes a first end and a second end, said second end permanently mounted to said first nozzle assembly, and said first end engaging said hub.

21. The sootblower device as set forth in claim 20, wherein said hub includes a sleeve seal assembly for providing sealed sliding engagement between said first end of said sleeve and said hub while accommodating movement of said first end of said sleeve relative to said hub.

22. The sootblower device as set forth in claim 21, wherein said hub includes an annular inner shoulder, and said manifold includes an annular face, said sleeve seal comprising rings of a compressible material which are stacked and compressed between said annular inner shoulder of said hub and said annular face of said manifold.

23. The sootblower device as set forth in claim 22, wherein said first nozzles are low dispersion water nozzles, and said second nozzles are converging/diverging steam nozzles.

* * * * *